United States Patent [19]

Capra et al.

[11] 4,174,052

[45] Nov. 13, 1979

[54] MECHANICALLY OPERATED DISPENSING DEVICE WITH EXPANSIBLE BULB

[75] Inventors: Nicholas G. Capra, East Hanover, N.J.; Roy Hammett, Miami, Fla.

[73] Assignee: James D. Pauls, Ltd., Miami, Fla.

[21] Appl. No.: 862,551

[22] Filed: Dec. 20, 1977

[51] Int. Cl.[2] ..... B05B 11/02

[52] U.S. Cl. ..... 222/207; 222/321; 222/335; 222/340; 239/321

[58] Field of Search ..... 222/135, 207, 209, 321, 222/335, 336, 340, 376, 383, 385, 396, 397, 402.13, 402.24, 402.25, 424, 488; 239/321, 331, 333; 417/462, 538

[56] References Cited

U.S. PATENT DOCUMENTS

| | | | |
|---|---|---|---|
| 2,461,121 | 2/1949 | Markham | 417/538 X |
| 3,452,905 | 7/1969 | Micallef | 222/321 X |
| 3,777,945 | 12/1973 | Nozawa et al. | 222/394 |
| 3,792,800 | 2/1974 | Capra et al. | 222/321 X |
| 3,921,861 | 11/1975 | Kondo | 222/340 X |
| 3,940,029 | 2/1976 | Horvath | 222/340 |
| 4,079,865 | 3/1978 | Kutik | 222/340 X |

*Primary Examiner*—Robert J. Spar
*Assistant Examiner*—Fred A. Silverberg
*Attorney, Agent, or Firm*—Dennis H. Lambert

[57] ABSTRACT

An economical and easy to operate mechanically operated dispensing device has a rotatable actuator connected with at least one expansible chamber to effect operation of the expansible chamber to draw material to be dispensed from a container into the expansible chamber and to then pressurize the material. An expansible bulb is connected with the expansible chamber and with a dispensing nozzle, and has a volumetric capacity several times as great as the expansible chamber. Valves are associated with the bulb to control flow into and out of the bulb, whereby the rotatable actuator and expansible chamber are operative to repeatedly draw material from the container, pressurize it and transfer it under pressure into the bulb, the bulb expanding as material is added thereto, and the elasticity of the bulb being such as to exert a substantial pressure on the material in the bulb. Subsequent operation of the dispensing nozzle releases the material from the expanded bulb, and the bulb returns to its normal, at-rest condition. The relative sizes of the expansible chamber and bulb are such that a hydraulic force multiplication is obtained from the expansible chamber into the bulb, whereby very little effort is required to operate the rotatable actuator. Additionally, return of the bulb to its at-rest condition after a dispensing operation results in longer life for the bulb and prevents stretching or loss of tension in the bulb.

34 Claims, 32 Drawing Figures

FIG. 5.
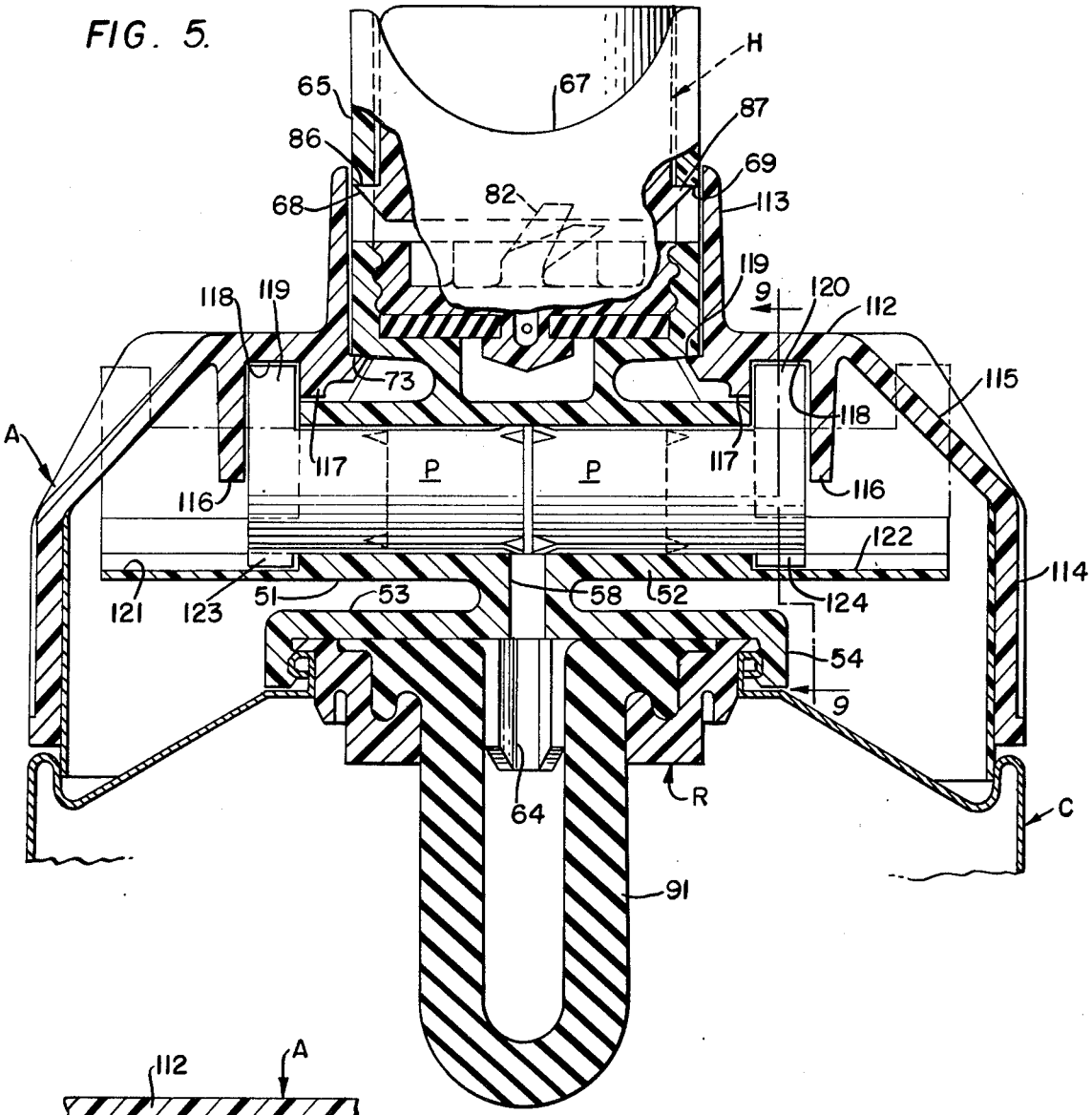
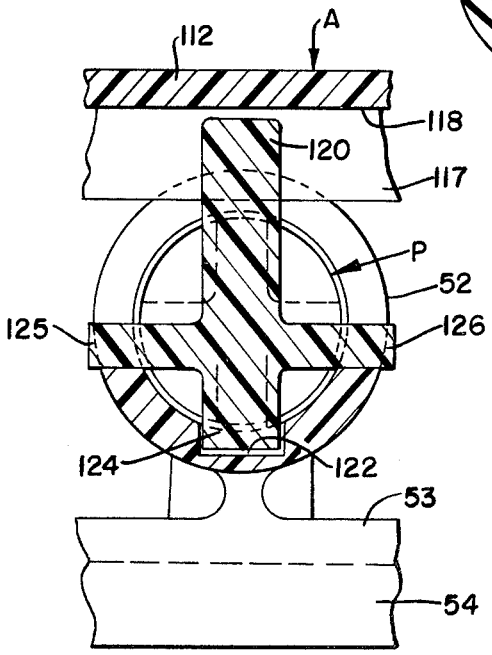
FIG. 9.

MECHANICALLY OPERATED DISPENSING DEVICE WITH EXPANSIBLE BULB

BACKGROUND OF THE INVENTION

This application represents an improvement over prior copending application Ser. No. 729,830, filed on Oct. 5, 1976.

This invention relates generally to dispensing devices and more particularly to an aerosol dispenser which does not rely upon chemical propellants and the like for discharging the product dispensed.

Although aerosol dispensers are exceptionally convenient spray devices and have enjoyed a growth pattern achieved by few packaging systems, they have many disadvantages. For example: manually operated spray pumps are unable to duplicate aerosol dispenser performance; recent evidence indicates that the ozone layer is being depleted by the propellants used in aerosol spray devices; many deaths and illnesses are reported each year due to the use or inhaling of chemical propellants by persons seeking to obtain drug related effects therefrom; shipping, handling and storing of the conventional, pressurized containers requires special procedures; pressurized aerosol dispensers require special disposal precautions; strict requirements must be met and procedures followed in connection with the filling of aerosol dispensers utilizing chemical propellants; and many products cannot be packaged in such devices because of chemical incompatibility between the product to be dispensed and the chemical propellant.

Many efforts have been made in the prior art in order to overcome one or more of the difficulties enumerated above. For example, attempts have been made at developing finger operated pump dispensing devices or trigger dispensing devices which do not rely upon chemical propellants for effecting pressurized discharge of the product. However, such devices have only partly solved the problem of providing a convenient yet safe and effective dispensing device. For example, users of the finger operated pump and trigger devices experience finger fatigue, and because of the action or force exerted to operate such devices it is difficult for the user to consistently achieve accuracy in spray direction. Further, such devices do not provide for duration spray and except for some devices the pressure does not remain constant throughout a discharge cycle. Thus, with such devices a fine spray might be achieved initially during a discharge cycle but near the end of the discharge cycle the pressure deteriorates rapidly and the spray deteriorates into a wet stream or dribble.

There are many other problems with existing propellant operated aerosol devices and with pump or trigger operated spray devices. For example, when chemical propellants are used the product discharged may feel cold to the skin of the user, and the design and structure of the containers is determined by the presures which must be withstood. On the other hand, some finger operated pumps and triggers are not capable of generating sufficient pressure to obtain a fine mist or suitable atomized spray for use with many products such as personal care products in the nature of cosmetics and hair sprays and the like, and the duration of spray obtained is limited in most instances by the length of stroke of the pump or trigger.

U.S. Pat. Nos. 3,761,022 and 3,921,861 are exemplary of some of the prior art efforts to solve the above problems. Other patents which disclose various approaches to solving the problems enumerated above are: U.S. Pat. Nos. 3,746,260, 3,777,945, 3,790,034, 3,799,448, 3,865,313 and German Pat. No. 2,315,467 of 1973.

All of the prior art patents enumerated above are either excessively expensive and difficult to manufacture and/or do not provide sufficient pressure for the desired spray pattern and/or do not provide sufficient spray duration and/or the user experiences finger fatigue and spray misdirection when using the devices.

The present invention provides a structure which solves the above problems relating to spray duration and pressure, and yet is economical to make and easy to use. Additionally, the device of the present invention may be made of biodegradable materials, or inexpensive, recyclable aluminum. In fact, the device and the containers associated therewith can both be readily made from inexpensive, recyclable aluminum.

OBJECTS OF THE INVENTION

Accordingly, it is an object of this invention to provide an economical and easy to manufacture dispensing device for discharging a wide variety of products under sufficient pressure to obtain a fine mist or spray thereof.

Another object of the invention is to provide an aerosol dispensing device which does not rely upon chemical propellants for obtaining pressurized discharge of the product being dispensed and wherein a long duration, high pressure spray or discharge of the product is obtained.

A further object of the invention is to provide an aerosol dispensing device which utilizes mechanical means to pressurize the product for discharge of the product whereby any suitable and desired material may be used for constructing the container for the product and the container may be manufactured or styled with any desired design without regard to strength or structural requirements to contain pressure, as is necessary with prior art chemical propellant devices.

An even further object of the invention is to provide a mechanically operated dispensing device constructed to obtain duration, high pressure spray wherein the dispenser is entirely self contained for application to either a new or existing container.

Yet another object of the invention is to provide an aerosol dispensing device which does not rely upon chemical propellants for obtaining pressurized discharge of the product being dispensed and wherein the dispensing device can be accomodated on all conventional piston and aerosol filling lines.

Still another object of the invention is to provide an aerosol dispenser which is capable of achieving a high pressure, long duration spray of product and which meets all known and anticipated government legislation concerning the regulation of such dispensers.

Still another object of the invention is to provide an aerosol dispenser which is capable of achieving high pressure, long duration sprays wherein there are no metal parts used in the construction of the dispensing device.

An even further object of the invention is to provide an aerosol dispenser which can be completely manufactured from biodegradable materials and which can be incinerated if desired.

A still further object of the invention is to provide an aerosol dispenser for dispensing product under pressure and over a relatively long duration of time wherein the device is constructed such that product pressurized therein is gradually leaked back into the container whereby the device cannot be charged with fluid or product and left unattended for subsequent accidental or inadvertent discharge by a child or the like.

A further object of the invention is to provide an aerosol dispensing device wherein spray performance is not affected by the position of the dispenser.

Other objects of the invention will become apparent upon a further study of the drawings and description which follow.

BRIEF DESCRIPTION OF THE DRAWINGS

FIG. 5 is a view similar to FIG. 4, taken along line 5—5 of FIG. 4.

FIG. 9 is an enlarged fragmentary view in section taken along line 9—9 of FIG. 5.

FIG. 39 is a fragmentary side view in elevation of a portion of the dispensing device showing a tamper proof and child-resistant structure associated with the head or cap of the device.

DETAILED DESCRIPTION OF THE INVENTION

Figure 1:
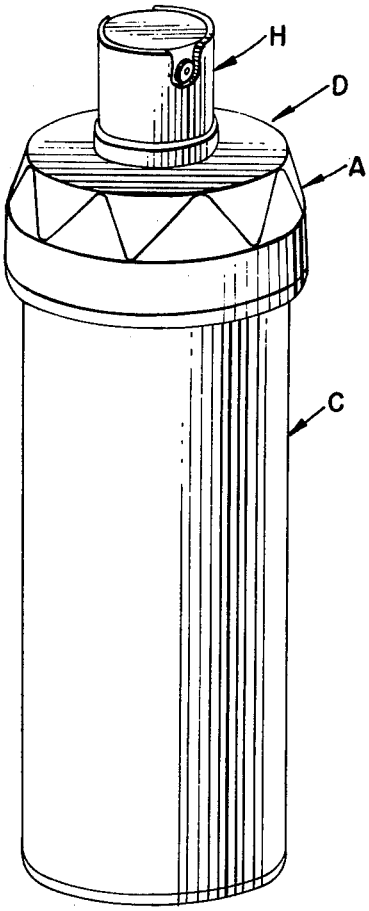
FIG. 1 is perspective view of a container having the dispensing device according to the invention affixed thereto.

In the drawings, wherein like reference numerals indicate like parts throughout the service views, a container C has a dispensing device D with a rotatable actuator A and a discharge head H, thereon.

Figure 2:
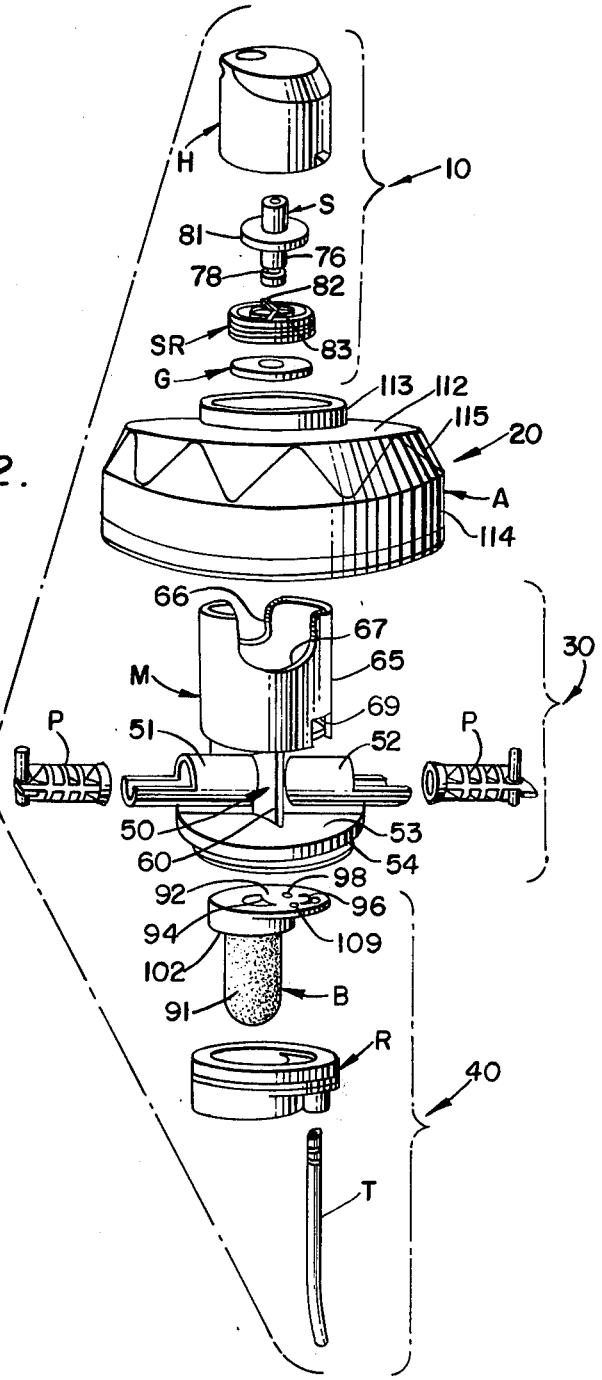
FIG. 2 is an enlarged, exploded, perspective view of a preferred form of dispensing device according to the invention.
Figure 3:
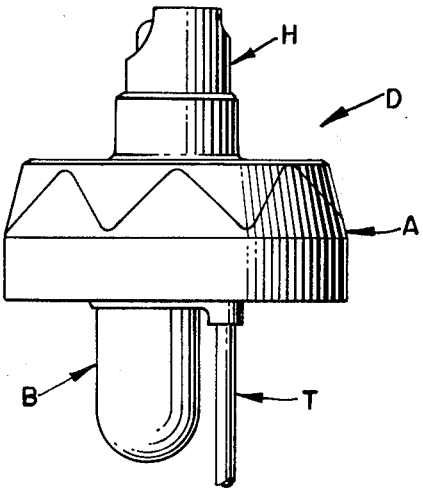
FIG. 3 is a side view in elevation of the dispensing device of FIG. 2, shown in actual size.

As seen in FIG. 2, the discharge device D comprises only 11 parts: the head H, a valve actuating stem S; a combined spring and retainer SR; a valve gasket G, a rotatable actuator or cam A, a one piece manifold M; pistons P; bulb or bladder B; bulb retainer R; and dip tube T. All of these parts may be made from non-metallic materials, such as rubber and/or plastic, if desired, and they may be formed by injection or injection blow molding or machining or the like, as desired.

The individual, molded or otherwise suitably formed components of the dispensing device D as listed above may be further considered as comprising four basic subassemblies, including: a discharge head subassembly 10 consisting of the head H, stem S, spring/retainer SR and discharge valve gasket G; an actuator subassembly 20 consisting of cam member A; a charging chamber subassembly 30 consisting of manifold M and pistons P; and an accumulating chamber subassembly 40 consisting of expansible bulb or bladder B, bulb retainer R and dip tube T.

Figure 4:
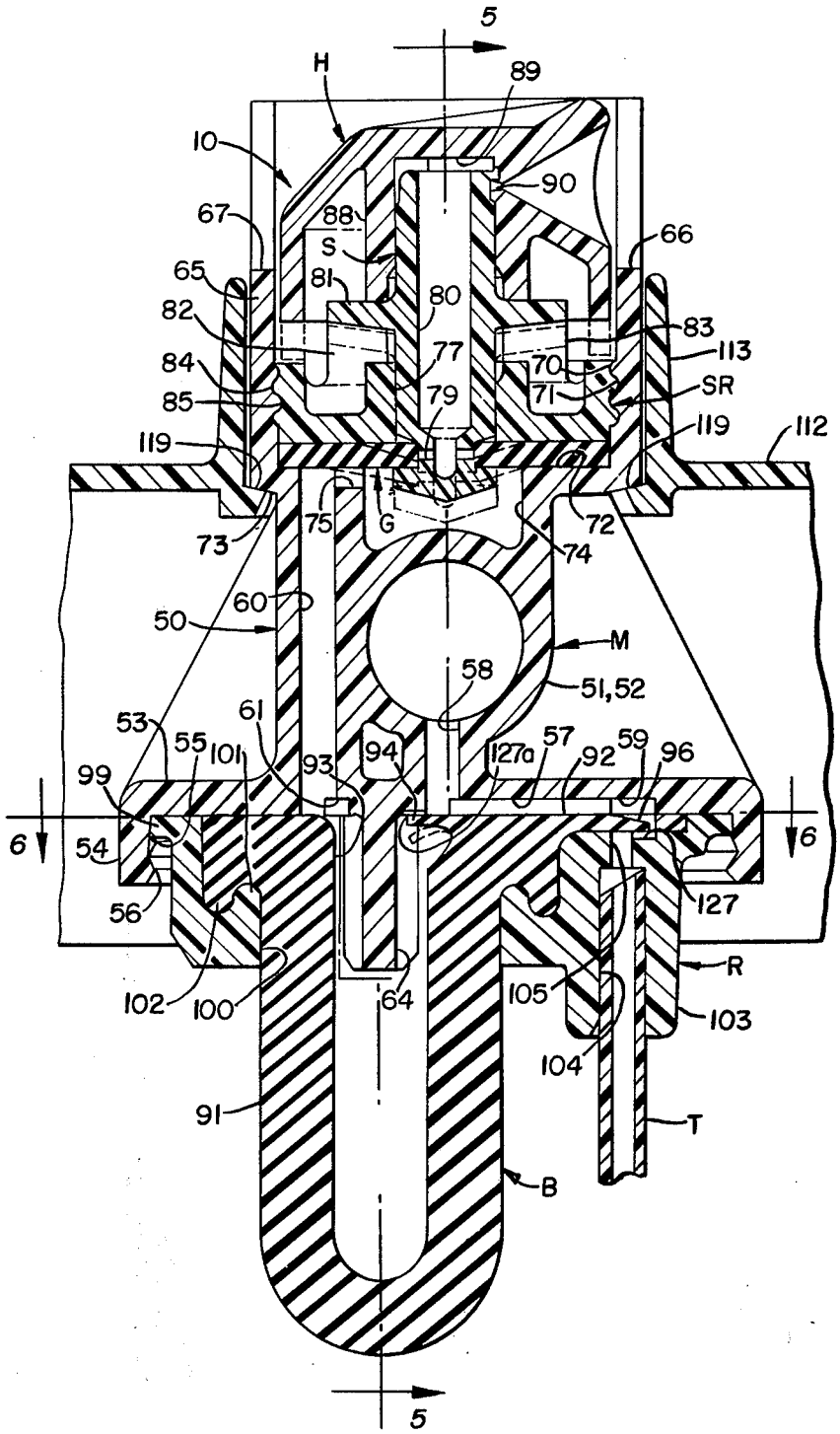
FIG. 4 is a greatly enlarged fragmentary view in section of the dispensing device of FIG. 2.

The charging chamber subassembly 30, and more particularly, the manifold M, comprises the basic frame or subcomponent to which the remaining components are assembled. Thus, the manifold M comprises a central body portion 50 having first and second opposed cylinders 51 and 52 formed thereon and in conjunction with the pistons P, which are adapted to reciprocate therein, defining the charging chamber means. A radially enlarged, generally circular wall 53 is formed on the bottom end of the central body portion 50 and has a cylindrical depending skirt 54 on the periphery thereof with first and second axially spaced, radially inwardly projecting ribs or detents 55 and 56 formed therein. As seen in FIGS. 4 and 5 the rib 55 is adapted to cooperate with the bulb retainer R to hold the bulb retainer in position in the skirt 54 and the rib 56 is adapted to cooperate with a complementary structure of a container C to hold the manifold to the container and to thus hold the dispensing device D to the container.

Figure 13:
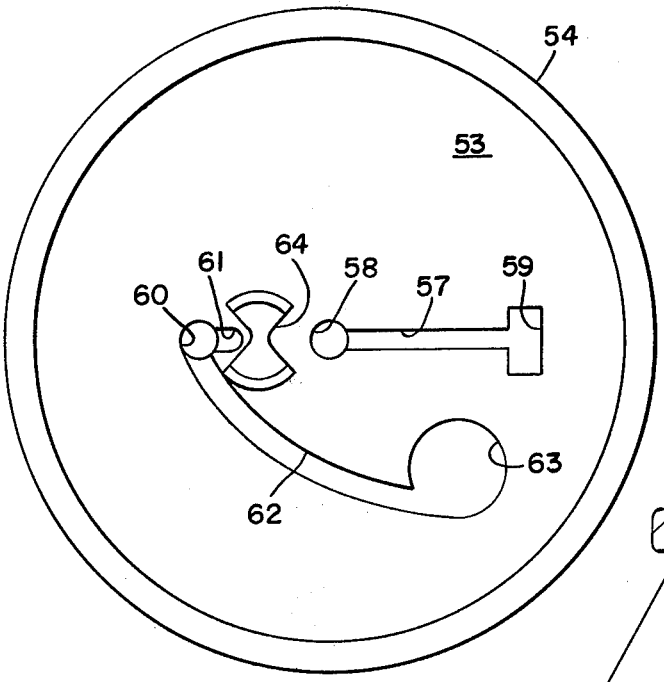
FIG. 13 is a bottom view of the mainfold of FIG. 10, looking in the direction of the arrow.
Figure 14:
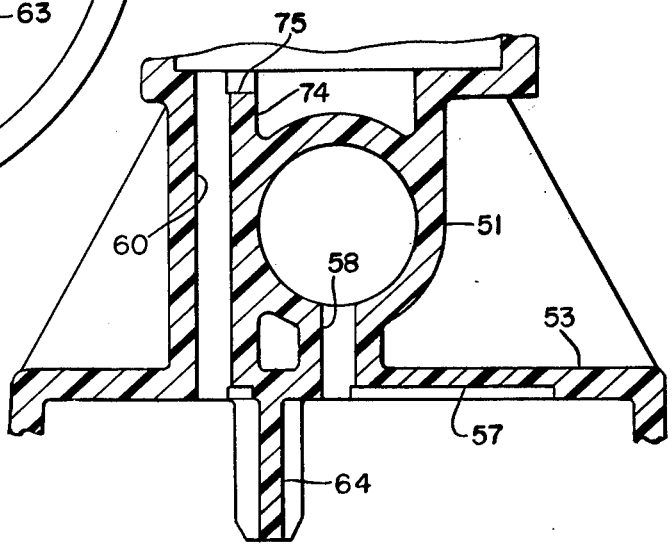
FIG. 14 is an enlarged fragmentary view in section taken along line 14—14 in FIG. 11.
Figure 15:
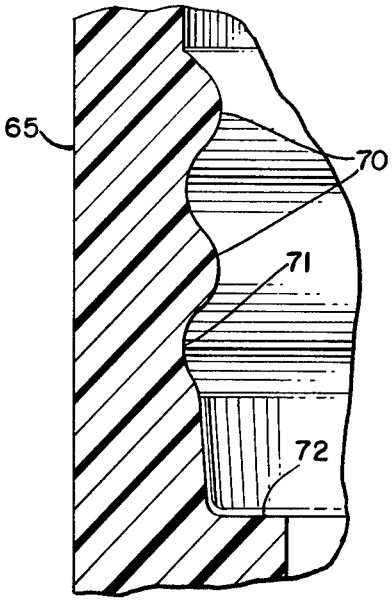
FIG. 15 is a greatly enlarged fragmentary view in section of the portion of the manifold shown in the circle in FIG. 10.

Referring particularly to FIGS. 4 and 13, a radially extending channel 57 is formed in the underside of bottom wall 53 and communicates at its radially inner end with an axially extending charging passage 58 and at its radially outer end with an enlarged chamber or valve recess 59. The charging passage 58 communicates at its upper end with the center of the chamber defined by cylinders 51 and 52. An axially extending discharge passage 60 is formed in the central body portion 50 of manifold M and extends at its bottom end through the lower surface of bottom wall portion 53 and communicates at its bottom end with a radial enlargement or recess portion 61 formed in the underside of bottom wall 53 of manifold M. The upper end of passage 60 opens through the upper end of the manifold.

The discharge passage 60 also communicates at its lower end with one end of an arcuate channel 62 formed in the undersurface of bottom wall 53 of the manifold, and the other end of arcuate channel 62 communicates with an enlarged circular recess 63 formed in the undersurface of wall 53.

A downwardly projecting sub or boss 64 is formed on the underside of wall 53 between the passages 58 and 60, and the stub 64 has a generally hourglass shaped configuration in transverse cross section.

An upstanding, generally cylindrically shaped superstructure 65 is formed on the upper end of central body portion 50 of the manifold and has an open upper end with a pair of substantially diametrically opposed, arcuately shaped notches or recesses 66 and 67 formed therein. A further pair of notches or cut-outs 68 and 69 are formed in the superstructure 65 at its lower end on diametrically opposite sides thereof and preferably on the same sides of the superstructure as the notches or cut-outs 66 and 67, although the notches 68 and 69 may be disposed or displaced 90 degrees from the notches or cut-outs 66 and 67.

A series of annular ribs and channels 70 and 71 are formed on the inner surface of the superstructure 65 at its lower end and the interior lower or bottom end of the superstructure is defined by a flat, upwardly facing surface 72. The outer bottom surface of the superstructure 65 defines an annular, downwardly facing shoulder 73.

The central portion of bottom surface 72 of the superstructure is hollowed out, defining a chamber or cavity at 74, and the axial passage 60 communicates therewith by means of a short, laterally extending passage 75 between the upper end of axial passage 60 and the chamber 74.

The discharge head subassembly 10 is assembled by inserting the lower end 76 of the stem S through the central opening 77 formed in the spring/retainer member SR and placing the valve gasket G over the lower end of the stem beneath the spring/retainer member SR. The lower end of the stem S has an annular channel 78 formed therein with radial passages 79 extending inwardly from the channel 78 to an elongate passage 80 extending upwardly through the stems S and opening through the upper end thereof. The stem has a radially enlarged annular collar or flange 81 formed thereon, approximately midway between the upper and the lower ends thereof and when the stem S, spring-/retainer Sr and valve gasket G are assembled, as above described, the flange 81 is spaced upwardly from the spring/retainer member SR when the valve gasket G is engaged against the underside of the spring/retainer SR. In fact, the spring/retainer SR has a pair of integrally formed, resiliently yieldable, angularly upstanding, diametrically opposite spring elements 82 and 83 which project above the upper surface of spring-/retainer SR and engage against the underside of flange 81 on the stem S to hold the stem S upwardly with the valve gasket or disc G engaged in flatwise contact against the underside of the spring/retainer SR. With the parts in this position the inner annular surface of valve gasket G engages snugly in the channel 78 and closes off the radial ports or passages 79.

The outer cylindrical surface of spring/retainer SR has a plurality of ribs and channels 84 and 85 thereon which are complemental to the ribs and channels 70 and 71 on the inner surface of the superstructure 65, whereby when the assembled stem, spring/retainer and valve gasket are inserted into the open upper end of the superstructure, the interengaging ribs and channels 70, 71 and 84, 85 securely retain the parts in assembled relation with the valve gasket G clamped in flat, planar relationship between the underside of spring/retainer SR and the surface 72 at the bottom of the cylindrical superstructure 65.

The head H has a pair of outwardly projecting locking lugs 86 and 87 thereon which snap into the cut-outs 68 and 69 in the superstructure 65 when the head H is pushed down into the open upper end of the superstructure. As seen best in FIG. 4, the head H has a downwardly projecting, inner cylindrical boss 88 in which the upper end of stem S is received, and the upper inner end of boss 88 is undercut at 89 to provide clearance with the upper end of stem S whereby product flowing upwardly through discharge passage 80 in the stem is enabled to flow through the undercut portion 89 into the nozzle 90 for discharge as desired.

Figure 6:
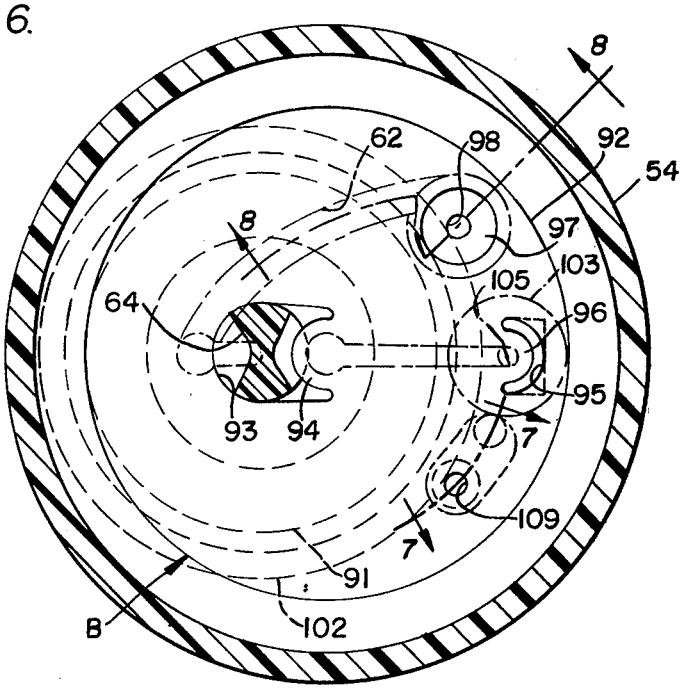
FIG. 6 is a view in section along line 6—6 in FIG. 5.

The expansible bulb or bladder B of the accumulating chamber subassembly 40 comprises a one piece, integrated expandable reservoir 91 and generally circular, disc-shaped valving plate or disc 92. The expandable reservoir 91 is disposed eccentrically relative to the valving disc 92, and opens at its upper end 93 through the valving disc 92. A generally semicircular valve flap 94 is integrally formed with the disc 92 and projects partially into the open upper end 93 of expandable reservoir 91. When assembled, as seen in FIGS. 4, 5 and 6, the stub 64 on manifold M projects downwardly into the open upper end 93 of expandable reservoir 91 and the valve flap 94 projects into the concavity at one side of the stub 64 (see FIG. 6). Further, an arcuate, generally semicircular slot 95 is formed in the valving disc 92 near the outer periphery thereof in a position to be in registry with the undercut portion or cavity 59 in bottom wall 53 of manifold M and the slot defines a valve flap 96. The valve flaps 94 and 96 comprise check valves which operate to control flow from the container to the cylinders 51 and 52 on a suction stroke and from the cylinders 51 and 52 to the expandable reservoir 91 on a compression stroke of the pistons.

Figure 8:
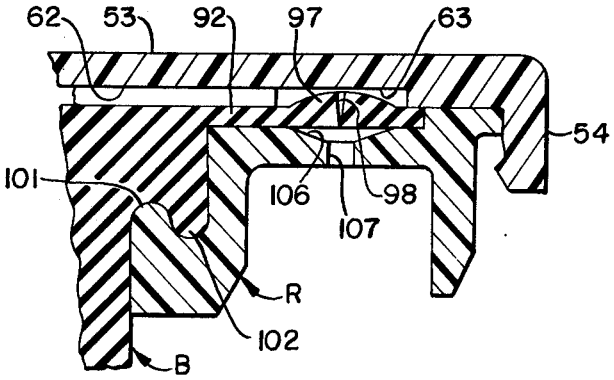
FIG. 8 is an enlarged fragmentary view in section of the pressure relief valve used with the invention and is taken along line 8—8 in FIG. 6.
Figure 11:
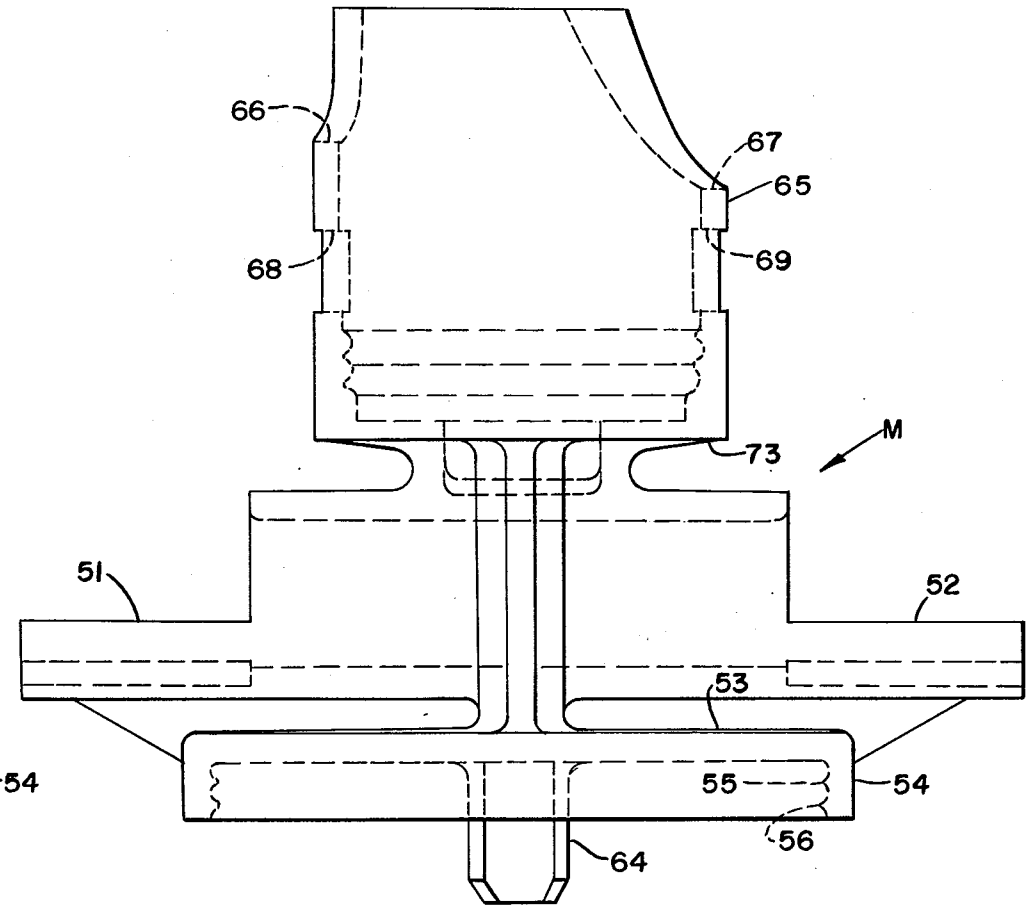
FIG. 11 is an enlarged side view in elevation of the manifold of FIG. 10.
Figure 10:
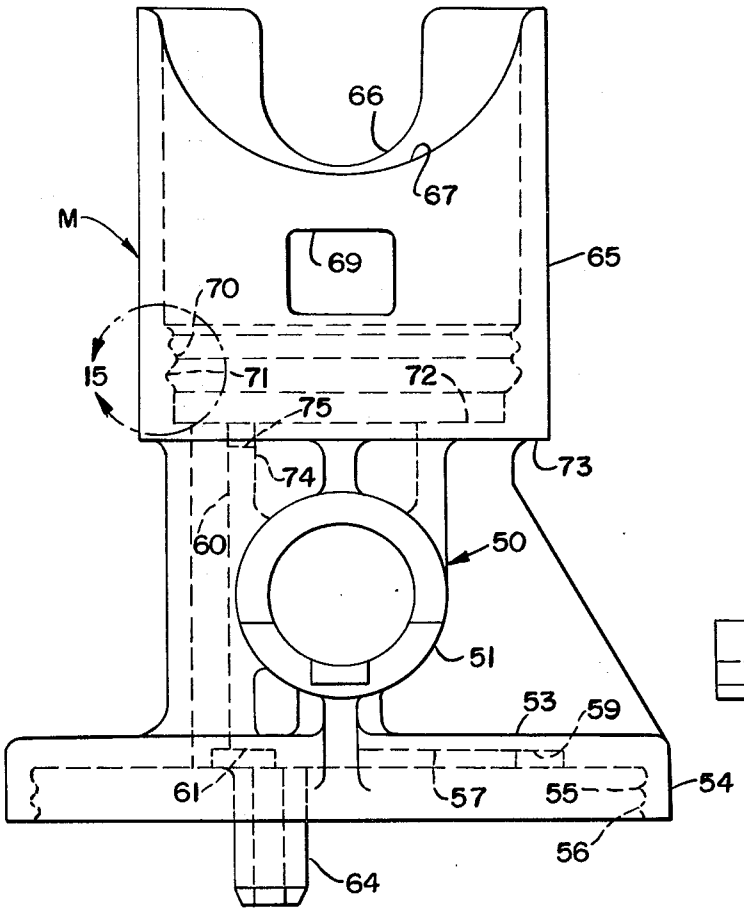
FIG. 10 is an enlarged rear view in elevation of the manifold used in the dispensing device of the invention.
Figure 12:
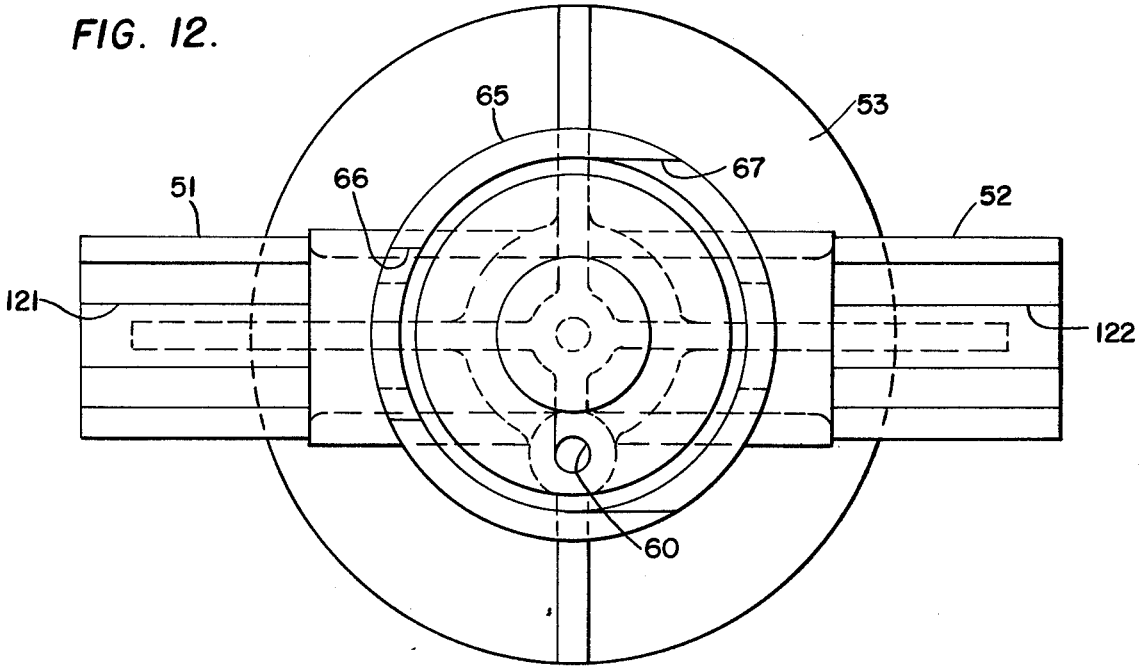
FIG. 12 is a plan view of the manifold of FIG. 10.

The valving disc 92 also has a thickened portion 97 therein with an opening 98 formed therethrough, forming an overpressure relief valve which is in registry with the undercut portion 63 and passage 62 when the parts are operatively assembled together (See FIG. 8).

The bulb or bladder B is securely held in assembled relationship relative to the manifold by means of the retainer R, and as seen best in FIGS. 4 and 5, the retainer has a radially outwardly extending flange 99 thereon which snaps behind the rib 55 in the cylindrical skirt 54 of manifold M. The retainer R has an eccentrically positioned opening 100 there through through which the expandable reservoir 91 is snugly received, and an upstanding annular rib or lip 101 is formed on the retainer R around the opening 100 for cooperation with a channel defined by a complementary shaped, downwardly projecting rib or lip 102 on the underside of valving disc 92 in concentric relation with the expandable reservoir 91, whereby an interlocking effect is obtained between the retainer and the expandable reservior. Further in this regard, the stub 64 serves as an inner restraining member or abutment which cooperates with the opening 100 through retainer R to confine the material of the bulb or bladder B to prevent the bulb or bladder from being displaced when it is filled with pressurized material.

A downwardly extending projection or boss 103 is formed on the underside of retainer R in side-by-side relation to the opening 100 and has a hollow interior 104 for receiving the upper end of tube T. An axially extending passage 105 communicates with the upper end of hollow interior 104 and thus with the tube T and flow therethrough is controlled by valve flap 96.

As seen in FIG. 8, the overpressure relief valve 97, 98 is arranged to be forced downwardly by pressure in excess of a predetermined pressure in channel 62 and cavity 63. In order to enable the overpressure relief valve to move downwardly in this manner, the retainer R has a recess 106 formed therein for providing clearance for the downward movement of the overpressure relief valve. A port or passage 107 is formed through the retainer R in communication with the recess 106 whereby material relieved through the overpressure relief valve is returned to the container.

Figure 7:
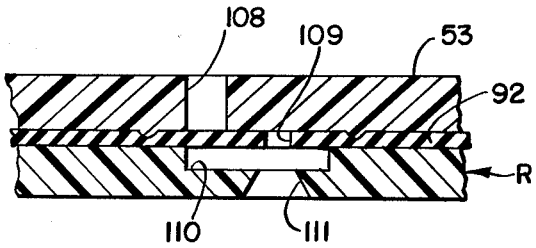
FIG. 7 is an enlarged fragmentary view in section of a vent value used with the invention and is taken along line 7—7 in FIG. 6.

Similarly, as shown in FIG. 7, an opening 109 is formed through the valving disc 92 in a position circumferentially spaced from valves 97, 98 and 95, 96 and serves as a vent opening to admit air to the interior of the container to replace product expelled therefrom. To this end, an opening 108 is formed through the circular bottom wall 53 of the manifold M in offset relation to the opening 109 through valving disc 92, and a recessed area 110 is formed in the retainer R below the valving disc 92 in alignment with the openings 108 and 109, and a port 111 communicates from the recess 110 to the interior of the container C. Accordingly, as material is expelled from the container through the dispenser D according to the invention, and the pressure in the container falls below atmospheric pressure the valving disc 92 is pulled downwardly into the recess 110, permitting the openings 108 and 109 to come into fluid communication with one another whereby air is admitted to the interior of the container through openings 108, 109 and 111.

Figure 19:
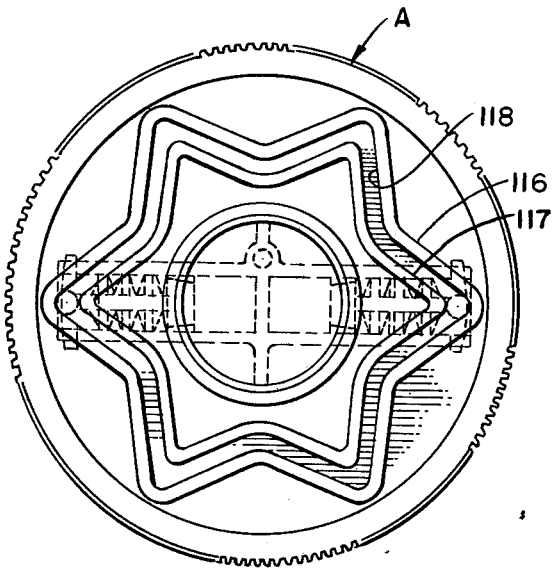
FIG. 19 is a bottom view of the cam member or manual actuator used on the dispensing device of the invention.

The actuator A includes a substantially flat upper wall 112 having a central upstanding cylindrical sleeve 13 formed thereon and a cylindrical depending skirt 114 connected to the wall 112 by a frustoconical shoulder portion 115. As seen best in FIGS. 5 and 19, a pair of substantially parallel serpentine depending walls 116 and 117 are formed on the underside of top wall 112 of actuator A, and define between them a serpentine channel or cam track 118.

An annular, radially inwardly directed flange or locking ring 119 is formed on the actuator A at the bottom of the upstanding cylindrical wall or sleeve 113 for locking cooperation beneath the shoulder 73 formed on the manifold M.

The pistons P have upstanding posts 119 and 120 on their outer ends which are received in the serpentine channel or cam track 118 whereby upon rotation of the actuator A, the undulating shape of the cam track 118 causes the pistons to reciprocate toward and away from one another in the cylinders 51 and 52 to alternately draw material upwardly through dip tube T, past valve 96, through channel 57 and passage 58 into the chamber defined by the cylinders, and thence, upon movement of the pistons toward one another, to flow downwardly through passage 58, past valve 94 and through the space defined between stub 64 and expandable reservoir 91 and into the reservoir.

Elongate guide channels 121 and 122 are formed in the bottoms of the rearwardly projecting portions of cylinders 51 and 52 and downwardly projecting guide posts 123 and 124 on the pistons P are slidably received therein and these guide posts cooperate with outwardly projecting wings or flanges 125 and 126 on the pistons which ride upon the upper surfaces of the semicylindrical rearward end portions of cylinders 51 and 52 to prevent the pistons P from rotating in their respective cylinders to maintain the posts 119 and 120 in their respective positions in the cam track 118.

Thus, with the components assembled as described hereinabove, wherein the components of the discharge head assembly 10, the accumulating chamber subassembly 40, and the actuator subassembly 20 are assembled to the manifold to form the dispensing device D, and the assembled components of the dispensing device D are then attached or assembled to a container C with the expandable reservoir 91 projecting downwardly into the container and the bottom end of skirt 114 of actuator A disposed closely adjacent the upper side edge of the side wall of the container C, a very compact, economical and easy to operate dispensing device or arrangement is provided.

OPERATION

In use, the actuator A is rotated in either a counterclockwise direction or a clockwise direction, or alternately in both directions to effect simultaneous reciprocation of the pistons P to draw material upwardly from the container, through the dip tube T, past valve 96, into the chamber defined by the pistons and cylinders and thence from the chamber downwardly through passage 58, past stub 64 and into the expandable reservoir 91. Twisting motion, in either a continuous single direction or alternately in opposite directions of the actuator A is continued to incrementally draw material from the container and discharge it into the expandable reservoir 91 until the desired amount of material has been charged into the reservoir. If operation of the rotary actuator is continued beyond the capacity of the expandable reservoir 91, the overpressure relief valve 97, 98 opens to return or relieve the excess pressure back into the container. With the desired amount of material in the expandable reservoir 91, the head H is pressed downwardly with the finger, thereby moving the stem S downwardly against the action of springs 82 and 83 and flexing the valve gasket G downwardly, as indicated in FIG. 4 in dot and dash lines, whereupon the inner peripheral surface of the valve gasket G pulls away from the surface of the channel 78 exposing the passages 79 to the pressure in the expandable reservoir 91 via passage 60, port 75 and chamber 74 whereupon the pressurized contents of the expandable reservoir are discharged through the nozzle 90, with the natural resiliency or elasticity of the expandable reservoir providing the requisite pressure to effect the desired discharge of the material.

As indicated at 127 and 127*a* in FIG. 4, very small bleed passages may be provided past the valves 94 and 96 whereby the pressurized contents of expandable reservoir 91 will be slowly returned to the container in the event the reservoir is charged with material and then left unattended without discharging the material therefrom. This provides a safety feature which prevents charging of the reservoir and subsequent inadvertent or accidental discharge of the contents by either a child or an adult, since the size of the passages 127, 127*a* is selected to enable the contents of the reservoir to leak back into the container over a relatively short period of time, yet over a period of time substantially longer than that normally encountered during a discharge or dispensing operation.

With the structure thus described, the dispensing device D accordingto the invention may be handled on conventional filling and capping lines with only slight modifications thereto, and may be attached to existing containers with the snap or crimp fit as indicated in FIG. 5. Alternatively, the manifold may be structured for cooperation with threaded containers if desired, whereby the dispensing device D of the invention may be attached to any style and type of container.

ALTERNATE FORMS OF THE INVENTION

Figure 16:
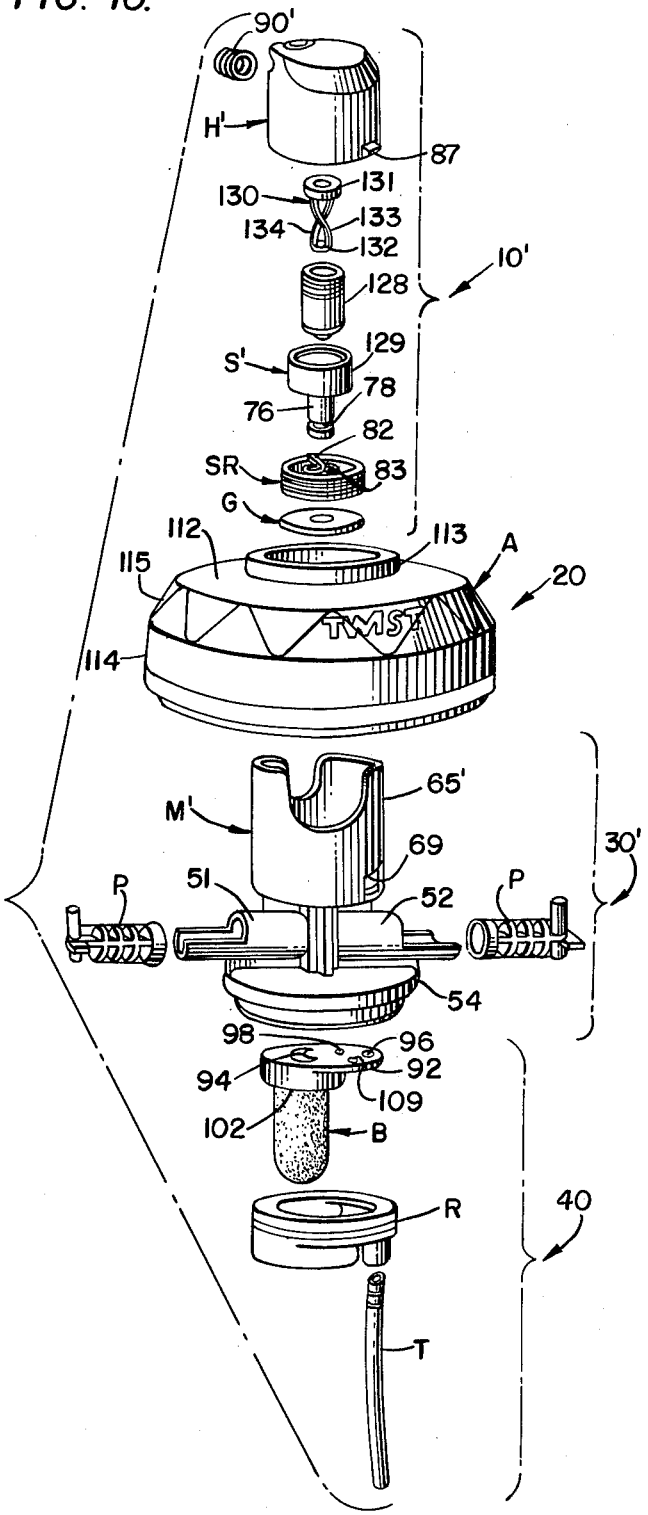
FIG. 16 is exploded perspective view of a modified form of dispensing device according to the invention wherein additional parts are provided to obtain a positive shut-off near the end of a dispensing cycle.
Figure 17:
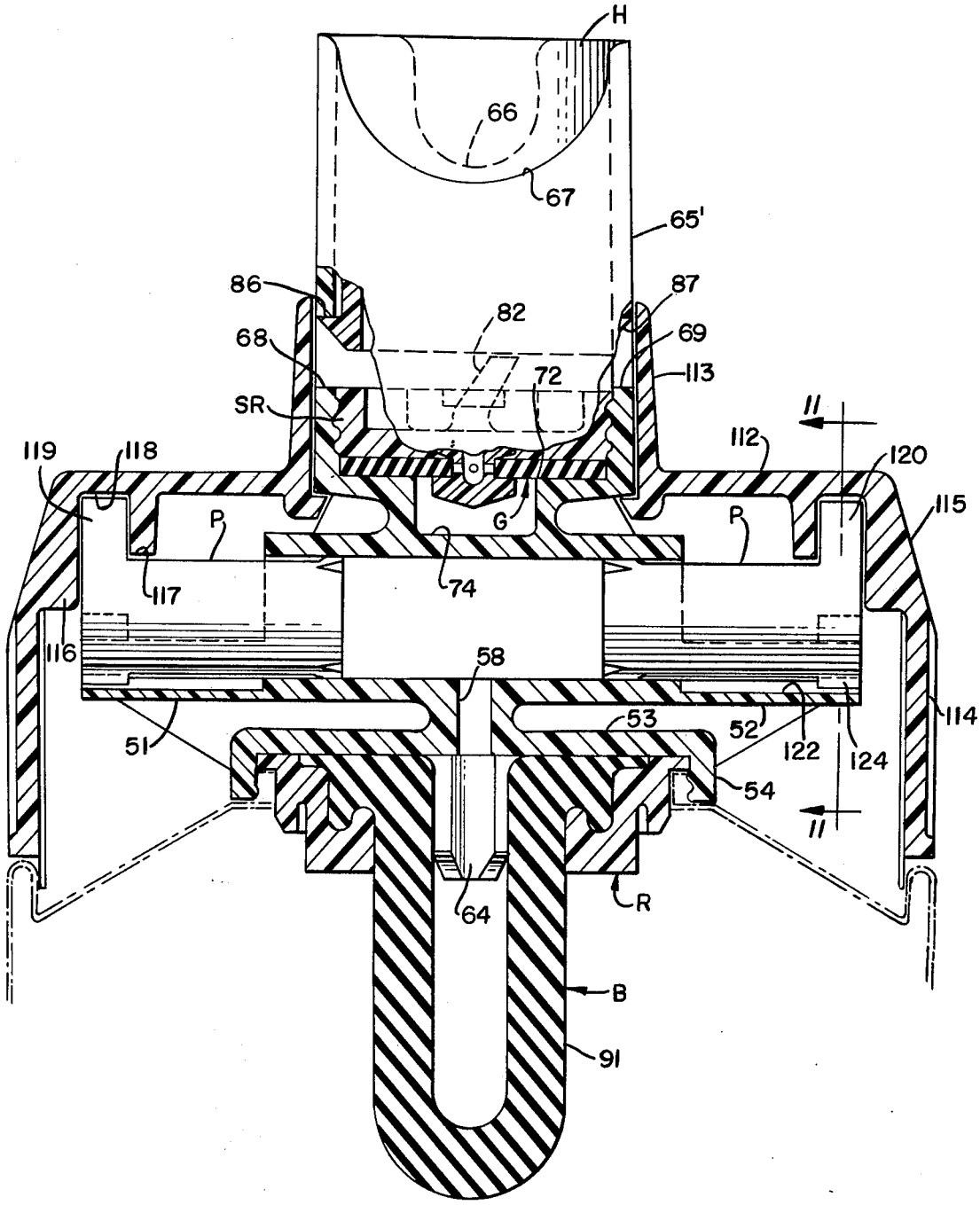
FIG. 17 is an enlarged view in section of the modified dispensing device of FIG. 16.

A modification of the invention shown in FIGS. 2 through 15 is indicated generally at D' in FIG. 16 and includes a discharge head subassembly 10', an actuator subassembly 20, a charging chamber subassembly 30' and an accumulating chamber subassembly 40. The principal difference between this form of the invention and that previously described is in the discharge head subassembly 10' wherein a positive shut-off valve 128 is provided for cooperation with a modified stem S', having an enlarged cylindrical upper end 129 thereon, for closing off the flow through the discharge head assembly when the pressure falls below a predetermined minimum whereby a satisfactory mist or spray is obtained throughout the discharge cycle.

Figure 18:
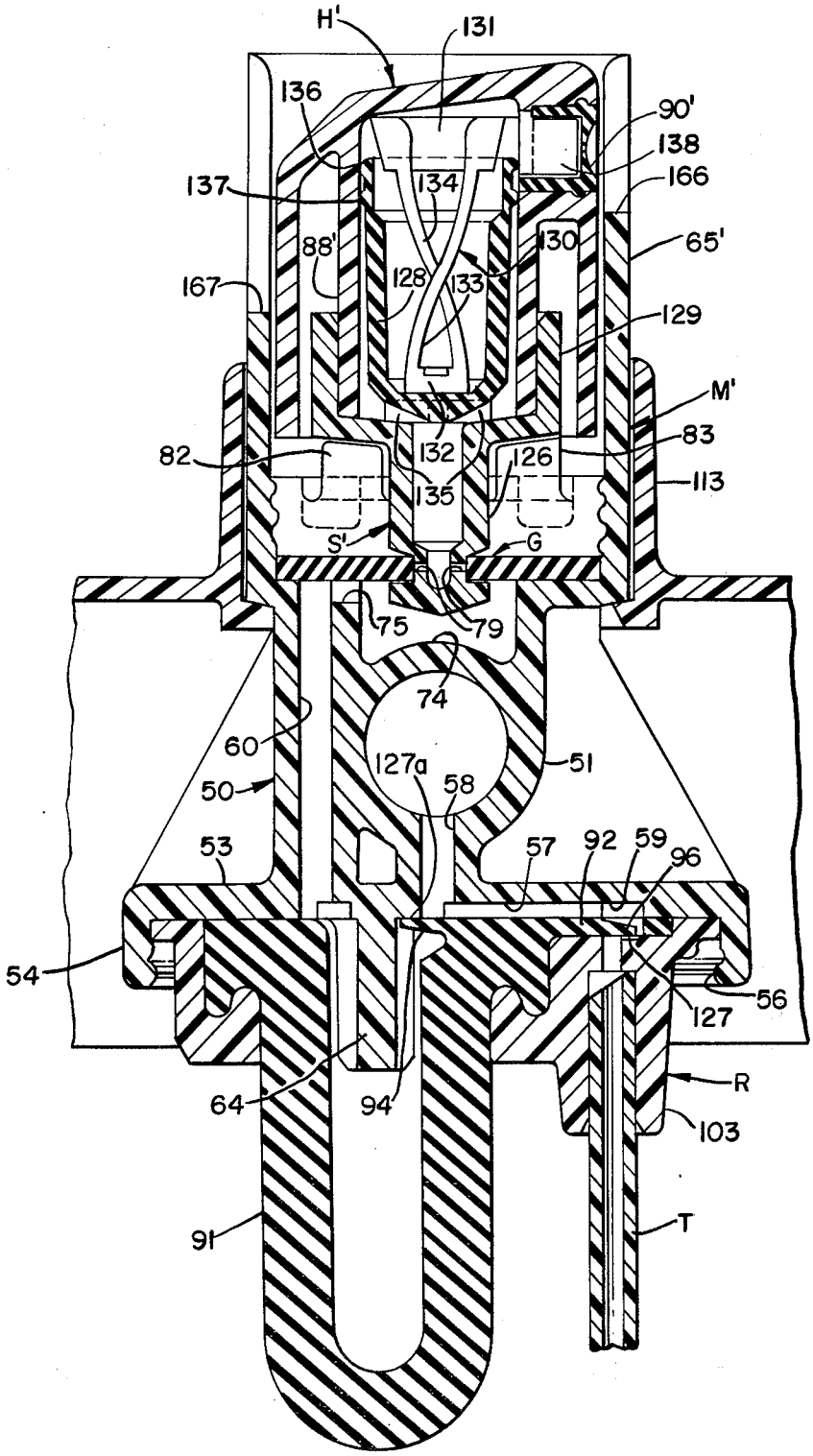
FIG. 18 is an enlarged view in section of the modified device and is taken along line 18—18 in FIG. 17.

A spring member 130 comprising an upper head member 131 and a lower head member 132, interconnected by a pair of helical, resilient spring members 133 and 134 is engaged between the valve member 128 and the inside of head H' to normally urge the valve 128 downwardly as seen in FIG. 18. Suitable flow by-pass means indicated here as ribs 135 are formed on the lower end of the valve 128, or alternately in the stem S', for normally permiting flow past the valve 128 into the hollow interior of downwardly projecting, cylindrical wall 88' in the head H'. A pair of axially spaced sealing rings or ridges 136 and 137 are formed on the upper end of valve 128 which sealingly engaged the inner cylindrical wall surface of wall 88' and when the valve 128 is in its lower position, as seen in FIG. 18, these sealing rings are disposed on opposite sides of an outlet or discharge passage 138, associated with the nozzle 90', whereby flow is precluded through the discharge head assembly. However, when the head H' is pushed downwardly to open the ports 79, as described in connection with the previous form of the invention, and high pressure fluid enters into the valve stem beneath the valve 128, the pressure of the fluid forces the valve 128 upwardly, with sealing ring 137 then being dis posed above discharge passage 138 whereby a spray of material is effected through nozzle 90'. However, when the pressure of the fluid being discharged falls below the amount necessary to overcome the bias of spring members 133 and 134, these spring members urge the valve 128 downwardly, again disposing sealing ring 137 below passage 138 and shutting off the flow.

In order to accomodate the extra valve 128 and its spring 130, the manifold M' has a longer upper cylindrical end portion 65' than in the previous form of the invention.

Also, as noted previously, the stem S' has an enlarged cylindrical upper end 129, which with the smaller lower end 76, defines a downwardly facing shoulder 139 against which the spring members 82 and 83 in the spring/retainer SR engage to normally maintain the stem S' in its up position as seen in FIG. 18 with the valve gasket G closed against ports 79. Further, whereas in the previous form of the invention the cylindrical wall 88 in the valve head H extended down in surrounding relation to the upper end of the stem S, the wall 88' in this form of the invention is received inside the upper cylindrical end 129 of the stem S'.

In all other respects this form of the invention is identical to that previously described.

A third form of the invention is indicated generally at D" in FIGS. 20–25 and comprises a discharge head subassembly 10", actuator subassembly 20', a charging chamber subassembly 30' and an accumulating chamber subassembly 40'.

The discharge head subassembly 10"is generally similar to that shown at 10' in FIG. 16 except that rather than the one-piece spring/retainer SR, a separate spring 140, such as a metallic coil spring or the like, is used with a separate retainer 141.

Further, the manifold M" has an upstanding, relatively short cylindrical wall 142 spaced inwardly from the cylindrical superstructure 65 and suitable detents such as ribs and channels, like those previously described, are formed on the inner surface of the wall 142 and on the outer surface of the retainer 140 for securing the retainer in place. The open lower end of head H' is arranged to move downwardly into the space between superstructure 65 and upstanding cylindrical wall 142.

The actuator subassembly 20' comprises a slightly different actuator A' having a larger diameter top wall 112 and a generally continuous, slightly curved, substantially cylindrical skirt 114' depending therefrom.

Figure 22:
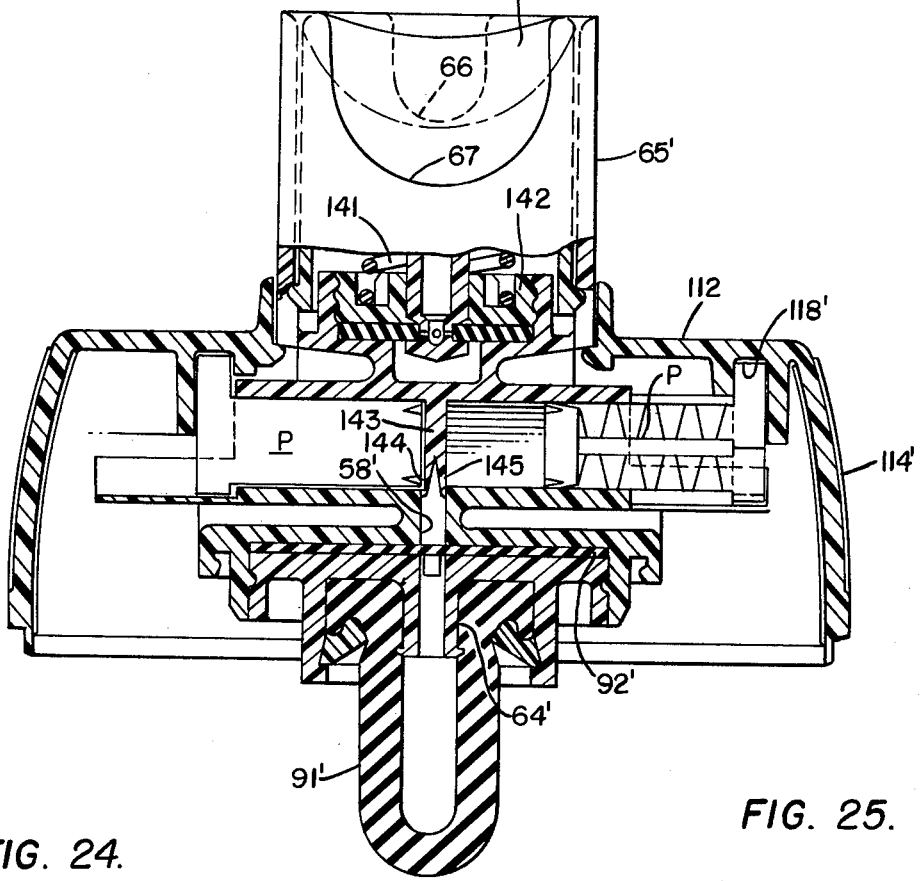
FIG. 22 is an enlarged view in section of the device of FIG. 21 and is taken along line 22—22 in FIG. 21.
Figure 24:
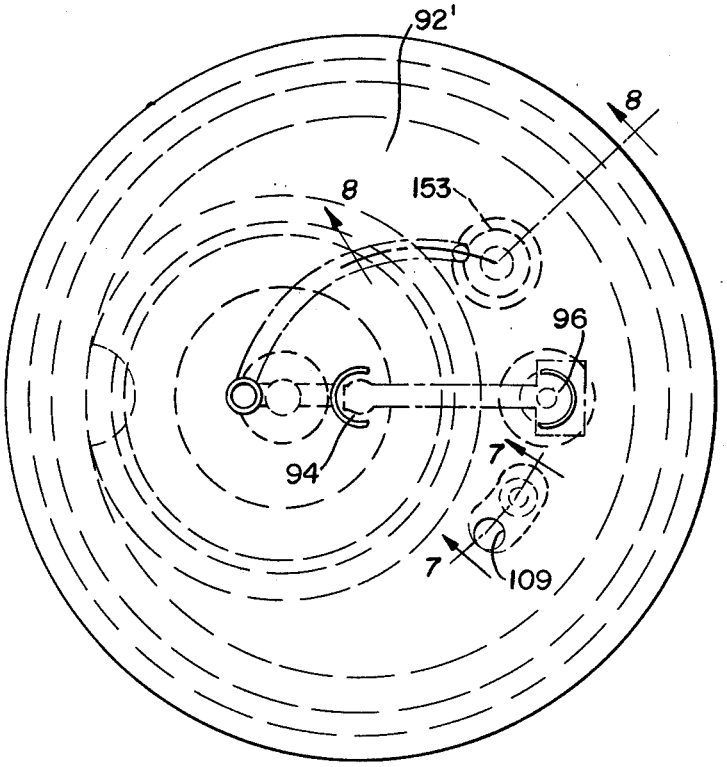
FIG. 24 is a greatly enlarged view in section of the manifold, retainer and expandible bulb or bladder of the invention and is taken along line 24—24 in FIG. 2.

The central body portion 50' of manifold M"includes a dividing wall or septum 143 between the cylinders 51 and 52, and as seen in FIG. 22, suitable flap valves 144 and 145 are arranged to control flow to and from the respective cylinders upon movement of the pistons therein in their respective inward and outward directions. In this connection, it will be observed that the cam track 118'is arranged such that when one of the pistons is moving inwardly during a compression stroke, the other piston is moving outwardly during a suction stroke. Of course, the pistons may be arranged to operate in unison toward and away from one another as in the previous forms of the invention, if desired.

As in the previous forms of the invention, a passage 58' communicates with the cylinders 51 and 52 at its upper end and with a radially extending channel 57 in the underside of bottom wall 53 of the manifold M''. However, rather than the unitary valving disc 92 and expandable reservoir 91 as described previously, a separate valving disc 92' is engaged against the underside of bottom wall 53 to control flow from the container to the cylinders and thence from the cylinders into the expandable reservoir 91' and ultimately, from the reservoir through the discharge head assembly for use as desired. The bottom wall 53 has a relatively short depending cylindrical skirt 54' thereon with a suitable detent 56' for cooperation with a container to lock the dispensing device D'' to the container, and a second cylindrical depending wall 146 is spaced radially inwardly from skirt 54' and has a channel 55' therein for cooperation with a rib 147 on the outer periphery of a modified retainer R' which is snapped into place within depending cylindrical wall 146 to hold the valving disc 92' securely in place. Further, the retainer R' has a downwardly extending projection 103 for attachment of the dip tube T as previously described and it has a downwardly projecting cylindrical wall 148 concentric with a depending wall 148 has a channel 149 therein for cooperation with a retainer ring 150 which engages beneath the circular flange 151 and depending lip 102 of bulb or bladder B' to securely hold the bulb in place. The retainer ring 150 is constructed such that increasing pressure inside the bulb tending to force the bulb from the retainer R' exerts a clamping force on the material of the bulb B' against the stub 64' to maintain it securely in position.

Figure 21:
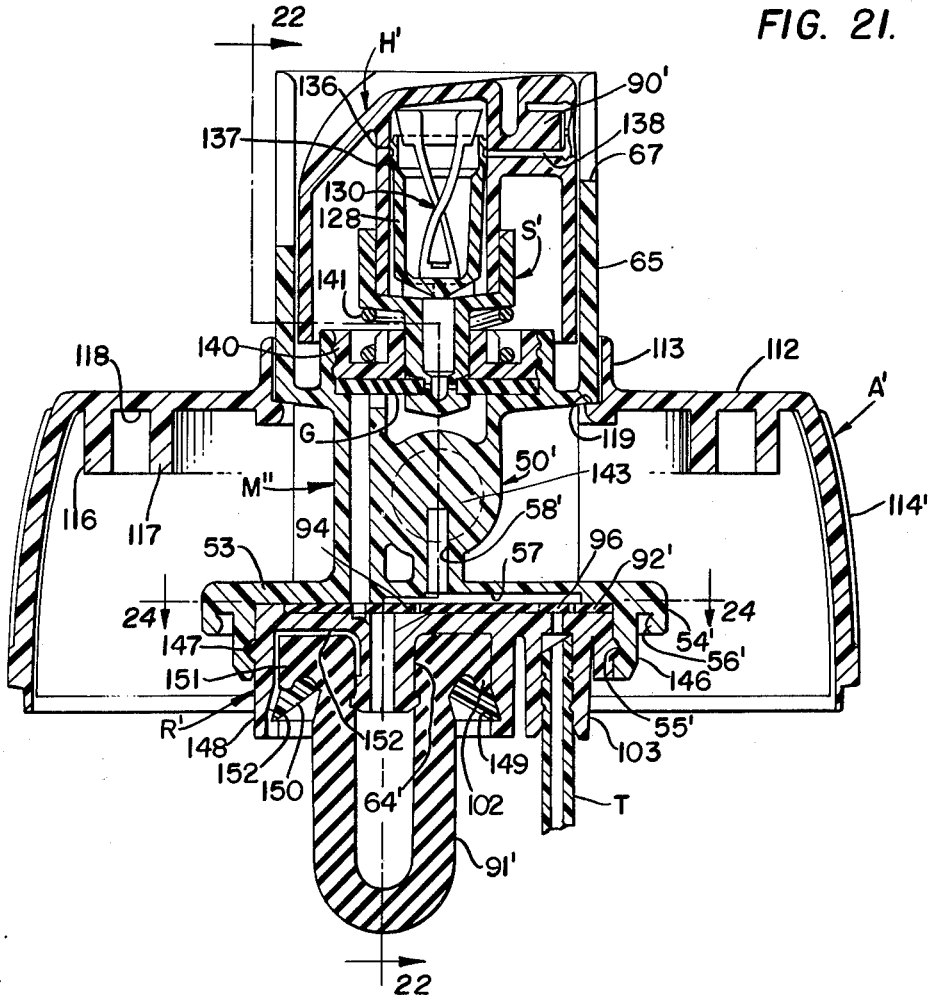
FIG. 21 is an enlarged view in section of the modification of the invention shown in FIG. 20.
Figure 23:
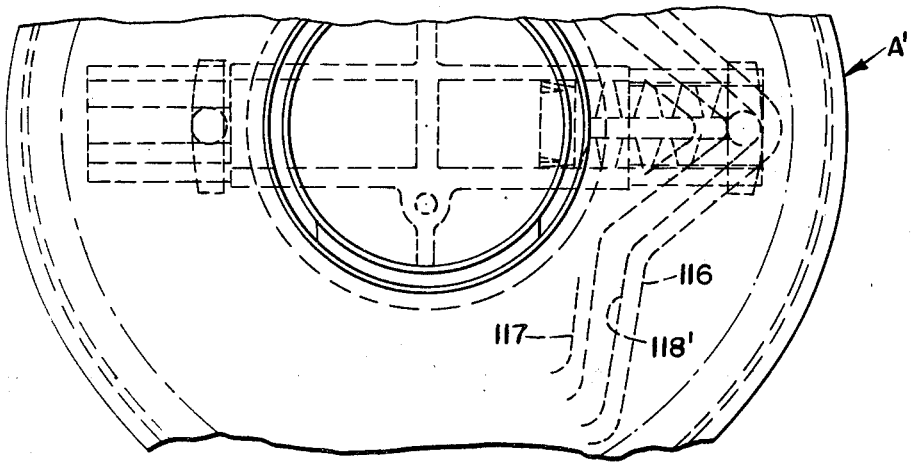
FIG. 23 is an enlarged, fragmentary, plan view of the actuator of the dispensing device of FIG. 21 showing a portion of the cam track and pistons in the associated cylinders of the manifold.
Figure 28:
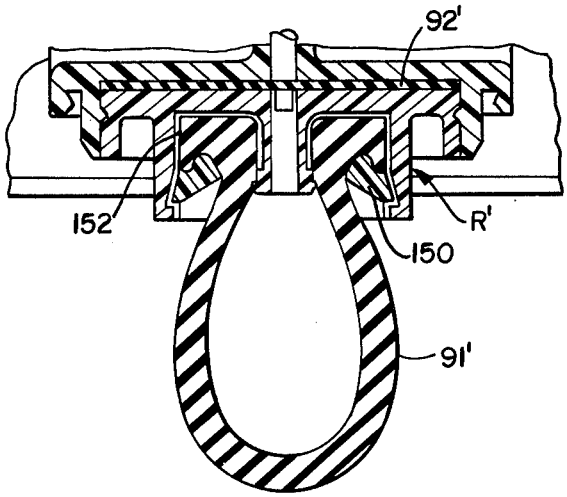
FIG. 28 is an enlarged fragmentary view in section of a portion of the manifold, the retainer and the expansible bulb or bladder of the invention showing the bulb expanded to capacity.
Figure 29:
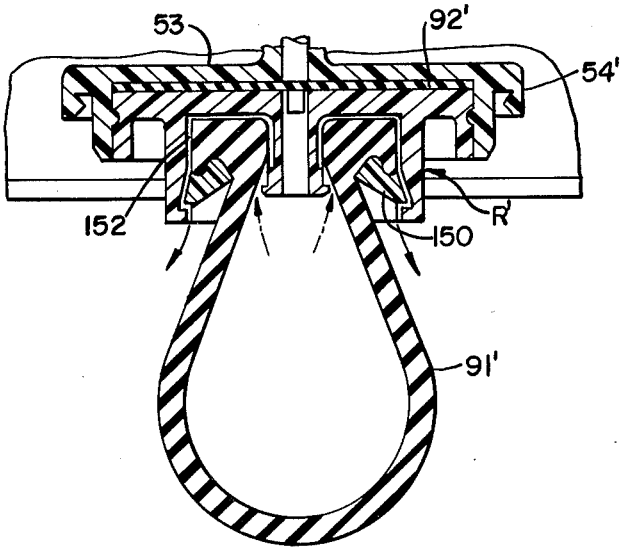
FIG. 29 is a view similar to FIG. 28, showing the bulb expanded beyond its capacity, and with the pressure relief passage opened.

In order to prevent overpressurization of the expandable reservoir 91', a channel 152 is formed in the retainer R' beginning at a point spaced upwardly from the lower end of stub 64' andcontinuing to the bottom of cylindrical wall 148. Thus, as seen in FIGS. 21 and 28, wherein the bulb is shown in its rest, unexpanded condition and in a normal, expanded condition, respectively, the inner surface of the upper end portion of the expandable reservoir 91' remains sealingly engaged against the uninterrupted lower end of stub 64' and the pressurized contents are maintained therein. However, when the pressure exceeds a predetermined amount, the inner surface of the expandable reservoir 91' pulls away from the lower end of stub 64', as seen in FIG. 29, enabling the excess pressure to escape through the channel 152 and back into the container C.

Figure 25:
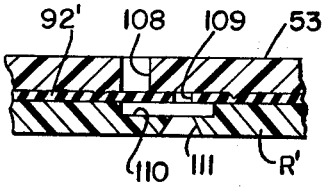
FIG. 25 is a greatly enlarged fragmentary view in section of a vent valve used with the form of the invention in FIG. 24 and is taken along line 25—25 in FIG. 24.

The vent 109 for admitting air to the container as product is expelled therefrom is illustrated in FIG. 25 and is identical to that previously described, wherein the vent 109 was formed in the integral valving disc 92 of bulb B. In this form of the invention the vent 109 is formed in the separate valving disc 92'.

Figure 26:
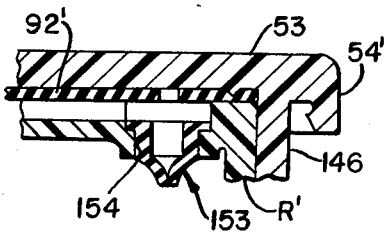
FIG. 26 is greatly enlarged fragmentary view in section of a first form of pressure relief valve for use with the dispensing device of FIG. 24 and is taken along line 26—26 of FIG. 24.

In FIG. 26 a moldified valve means 153 for venting excessive pressure from the expandable reservoir 91' is shown secured in an opening 154 in the retainer R'.

Figure 27:
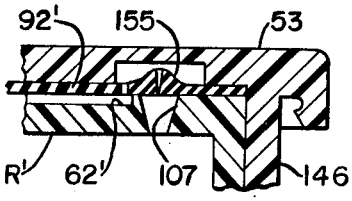
FIG. 27 is view similar to FIG. 26 of a modified relief valve for use with the invention.

A further modified overpressure relief valve 155 is illustrated in FIG. 27, wherein the relief valve 155 is formed in the valving disc 92' rather than separately affixed thereto as in FIG. 26, or provided as a channel in the retainer as in FIG. 21. The overpressured relief valve 155 functions sub stantially identically to the overpressure relief valve 97, 98 described in connection with the first form of the invention.

Figure 20:
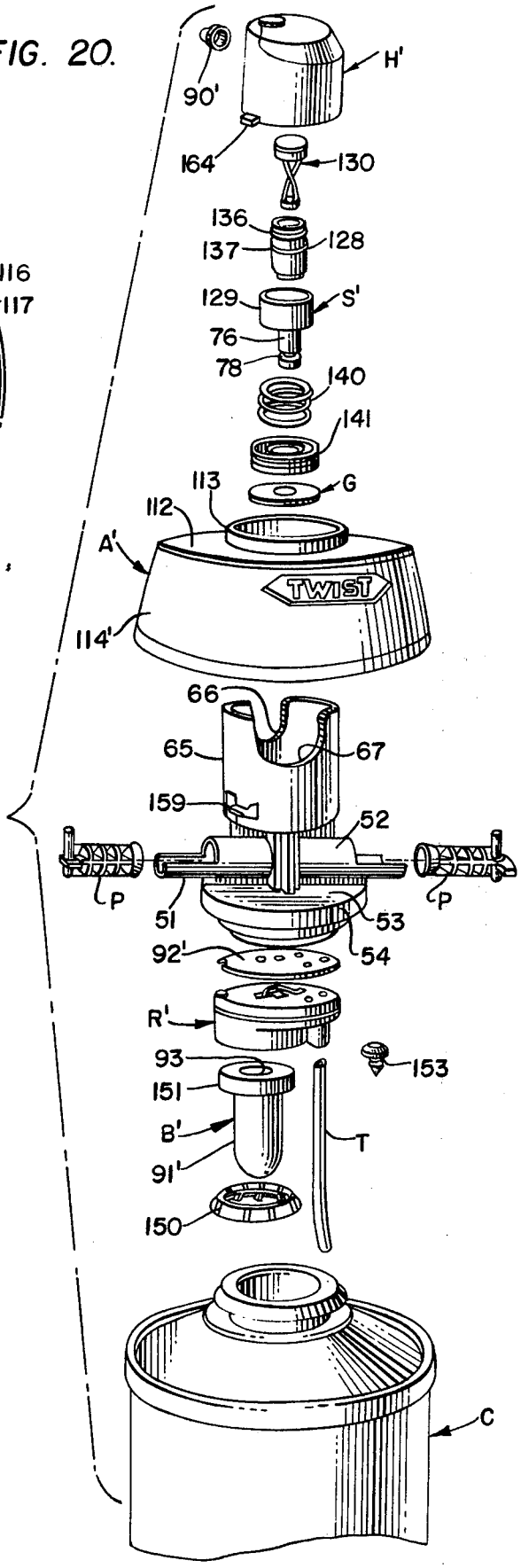
FIG. 20 is an exploded perspective view of a third form of the invention wherein different arrangements of springs and valves are used from that in the preceeding forms of the invention.
Figure 32:
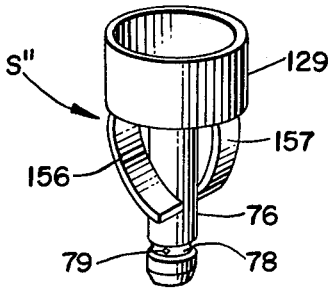
FIG. 32 is an enlarged perspective view of a modified valve stem and spring arrangement for use with the various forms of the invention disclosed herein.

A still further modification of the stem is indicated generally at S''in FIG. 32, and this form of the invention is similar to that shown in FIGS. 16 and 20, in that the stem includes a reduced diameter lower end portion 76 having the channel 78 and ports 79 therein and an enlared cylindrical upper end portion 129. However, rather than the separate springs used with the previous forms of the invention, a pair of helically extending, flexible arms or spring members 156 and 157 are integrally formed with the stem S''for normally urging the stem in an upward direction for closing engagement of the valve gasket G in the channel 78 relative to the ports 79.

Figure 30:
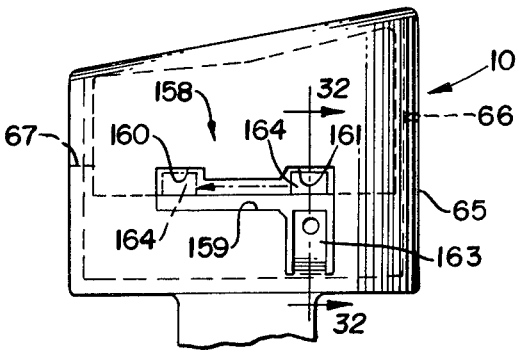
Figure 31:
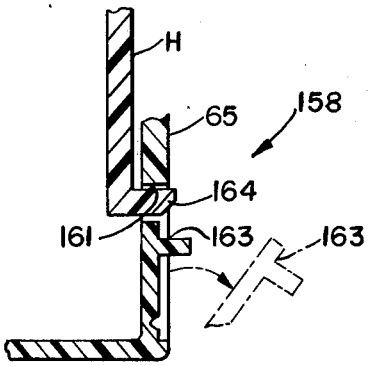
FIG. 31 is a greatly enlarged fragmentary view in section taken along line 31—31 of FIG. 30, showing the tamper proof tab in operative position in full lines and showing it removed in dot and dash lines.

The head H and superstructure 65 of any of the forms of the invention described herein may be provided with a tamper proof structure such as indicated generally at 158 in FIGS. 30 and 31. The tamper proof structure includes a circumferentially extending slot 159 formed in the side wall of the superstructure 65 and having a pair of upwardly extending recesses or cut-outs 160 and 161 at the opposite ends thereof and a depending cut-out or recess 162 at one of the ends thereof in which a frangible tab 163 is normally disposed until the dispensing device is ready for use. The head H has a radially extending foot or tab 164 which extends outwardly into the slot or channel 159, and prior to use of the device actuation of the head H is prevented by the frangible tab or strip 163 disposed in depending slot or cut-out 162. When it is desired to use the dispensing device, the tab 163 is removed from the slot 162 and the head H is rotated until the radially outwardly projecting tab 164 thereon is in vertical alignment with the slot 162 and thereafter the head H may be depressed to dispense material from the container with which the dispensing device is associated. When it is desired to the store the dispensing device, the head H is rotated to bring the tab 164 into alignment with recess or cut-out 160 and in this position the head H cannot be operated to discharge material from the container. Thus, this tamper proof structure provides a child safety feature since the head H must first be rotated to bring the tab 164 into alignment with slot 162 before it can be operated to dispense material from the container.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to be embraced by those claims. We claim:

1. A mechanically operated dispensing device, comprising: a manifold member having means thereon for attachment to a container; first expansible chamber means carried by the manifold member; manually operable actuating means carried by the manifold member and connected with the first expansible chamber means to operate the first expansible chamber means; second expansible chamber means carried by the manifold member and comprising an elastomeric bulb having a closed end and an open end and adapted to receive and store a quantity of material under pressure, the pressure being provided by the elasticity of the bulb; and one way means associated with the manifold member and with the first and second expansible chamber means to control flow from a container with which the dispensing device is associated into the first expansible chamber means, from the first expansible chamber means into the second expansible chamber means for accumulation of a quantity of material to be dispensed, and from the second expansible chamber means to a point of use.

2. A dispensing device as in claim 1, wherein the manifold member comprises a midbody portion, a top body portion and a bottom body portion, said elastomeric bulb being secured to the bottom body portion, and the first expansible chamber means being carried by the said midbody portion.

3. A dispensing device as in claim 2, wherein the actuating means comprises a rotatable, annularly shaped member carried by the manifold and disposed in covering relationship to the midbody portion of the manifold member.

4. A dispensing device as in claim 3, wherein the manifold member is of one-piece construction, and the first expansible chamber means comprises piston and cylinder means, the cylinder means being formed integrally in the manifold member.

5. A dispensing device as in claim 4, wherein the valve means includes a plurality of one-way check valves connected between the container and the first expansible chamber means and between the first expansible chamber means and the second expansible chamber means, and a manually operated discharge valve connected between the second expansible chamber means and a dispensing nozzle.

6. A dispensing device as in claim 5, wherein the manually operable discharge valve means includes a reciprocable valve member movable between closed and open positions, and spring means engaged with the valve member normally urging it to a closed position.

7. A dispensing device as claim 6, wherein a discharge spray head is connected to the reciprocable valve member and is manually engageable to move the valve member to its open position.

8. A dispensing device as in claim 6, wherein the elastomeric bulb and the check valve means comprise an integrally molded one-piece construction, the check valve means being formed in a radially enlarged, generally circularly shaped valving disc integral with the bulb.

9. A dispensing device as in claim 8, wherein the top body portion of the manifold member comprises an upstanding cylindrical superstructure, and said discharge valve means, spray head, and spring means are carried by an confined within the superstructure.

10. A dispensing device as in claim 8, wherein the bottom body portion of the manifold member includes a generally circular shaped bottom wall having a cyindrical, depending annular skirt thereon, the undersurface of the bottom wall having channels formed therein, and said valving disc being disposed and held against the undersurface of the manifold member bottom wall and cooperating with the channels to define flow passages, said check valves positioned at the ends of the passages to control flow therethrough.

11. A dispensing device as in claim 10, wherein an overpressure relief valve communicates with the bulb and is openable by pressure in the bulb above a predetermined maximum pressure to return excessive fluid from the bulb back into the container.

12. a dispensing device as in claim 11, wherein a slow leak-back opening is in communication with the bulb to slowly leak pressurized fluid from the bulb back into the container, to thereby prevent the bulb from being charged or filled with fluid and left for long periods of time without.

13. A dispensing device as in claim 3, wherein the manifold member is of one-piece construction.

14. A dispensing device as in claim 1, wherein the first and second expansible chamber means, the actuating means and the manifold member comprise a unitary assembly for attachment to a container.

15. A dispensing device as in claim 14, wherein the means on the manifold member for attachment to a container comprises means structured for cooperation with conventional container constructions whereby the dispensing device may be attached to a conventional container without requiring modifications to the conventional container.

16. A dispensing device as in claim 1, wherein an overpressure relief valve communicates with the bulb and is openable by pressure in the bulb above a predetermined maximum pressure to return excessive fluid from the bulb back into the container.

17. A dispensing device as in claim 16, wherein a slow leak-back opening is in communication with the bulb to slowly leak pressurized fluid from the bulb back into the container, to thereby prevent the bulb from being charged or filled with fluid and left for long periods of time without being discharged.

18. A dispensing device as in claim 1, wherein the manifold member is of one-piece molded construction and comprises a top body portion, a midbody portion and a bottom body portion, said first expansible chamber means comprises a pair of diametrically opposed pistons reciprocable in cylinders formed integrally in the midbody portion, and said bulb is carried by and depends from the bottom body portion, said valve means including one-way check valves for controlling flow from the container to the cylinders and from the cylinders to the bulb upon operation of the pistons, and a manually operable discharge valve means carried by the top portion for releasing stored pressure fluid from the bulb.

19. A dispensing device as in claim 18, wherein the bulb has an open end and a closed end, and a radially enlarged, generally circular valving disc is integrally molded with the open end of the bulb, said check valves being formed in the valving disc.

20. A dispensing device as in claim 19, wherein the top body portion of the manifold member comprises an upstanding cylindrical superstructure with an open upper end, and the discharge valve comprises a reciprocable valve member disposed within the superstructure, spring means engaged with the valve member normally urging it upwardly to a closed position, and a manually engageable discharge spray head engaged with the valve member to move it downwardly against the bias of the spring means to open the valve member.

21. A dispensing device as in claim 20, wherein an annular bulb retaining member is secured to the bottom end of the manifold member, and the valving disc is clamped between the retaining member and the undersurface of the bottom end of the manifold member, said bulb projecting through an opening in the retaining member.

22. A dispensing device as in claim 21, wherein the discharge valve member comprises an elongate tubular stem open at its upper end and closed at its lower end and having an axial passage extending from adjacent the lower end through the open upper end thereof, said stem having an annular recess or channel in the lower end and at least one radial passage extending between the annular channel and the axial passage, a flexible, annular, washer-like valving member having an inner periphery and an outer periphery and engaged at its inner periphery in the annular channel in the stem closing the radial passage therein, the outer periphery of the annular valving member being secured in the superstructure at the lower end thereof, whereby downward movement of the stem causes flexing of the annular valving member and opening of the radial passage in the stem for flow of material from the bulb outwardly through a discharge nozzle.

23. A dispensing device as in claim 22, wherein an annular retainer is secured in the superstructure at the lwer end thereof and the outer periphery of the annular valving member is clamped between the retainer and the lower inner end surface of the superstructure.

24. A dispensing device as in claim 23, wherein the stem has an annular, radially enlarged, downwardly facing shoulder thereon between the ends thereof, and the spring means engages against the shoulder.

25. A dispensing device as in claim 24, wherein the stem has a substantially constant diameter throughout its length, and the shoulder is provided on the underside of a radially enlarged annular collar integrally formed on the stem, the spray head having a cylindrical skirt disposed around the upper end of the stem and engaged at its lower edge against the upper surface of the collar.

26. A dispensing device as in claim 25, wherein said spring means is integrally formed with said annular retainer.

27. A dispensing device as in claim 24, wherein the stem has a small diameter lower end and a larger diameter upper end, the shoulder being formed at the juncture between the large and small diameter ends.

28. A dispensing device as in claim 27, wherein said spring means comprises a coil spring engaged between the retainer and the shoulder.

29. A dispensing device as in claim 1, wherein a discharge spray head having a spray nozzle is carried by the manifold member, and a normally closed, positive shut-off valve is disposed between the bulb and the nozzle, said shut-off valve being openable by a predetermined pressure of fluid in the bulb and biased to a closed position below a predetermined pressure of fluid in the bulb, whereby a predetermined range of pressure is necessary to effect a dispensing operation and a satisfactory spray of fluid is thus obtained throughout a discharge cycle.

30. In combination, a container for a product to be dispensed, and a mechanically operated dispensing device carried by the container, said dispensing device comprising a manifold member having attaching means thereon attaching the dispensing device to the container, a discharge spray head carried by the manifold member and including a spray nozzle and a manually operable discharge valve, first expansible chamber means carried by the manifold member and constructed to alternately draw material from the container and then pressurize the material, second expansible chamber means carried by the manifold member and connected to receive and store pressurized material from the first expansible chamber means and to then discharge material to the discharge valve, said second expansible chamber means comprising an elastomeric bulb having a closed end and an open end, a flange on the open end, and retainer means secured to the manifold member in overlying relationship to the flange securing the bulb to the manifold member, the elasticity of the bulb exerting a pressure on the material stored therein, whereby when the discharge valve is opened, the material is forced under pressure from the bulb.

31. The combination as defined in claim 30, wherein a positive shut-off valve is connected between the spray nozzle and the bulb, said shut-off valve being normally closed, and openable by pressure in the bulb above a predetermined amount, whereby flow through the nozzle only occurs when pressure in the bulb is at least as great as said amount, thus insuring a satisfactory spray of material throughout a discharge cycle.

32. The combination as in claim 31, wherein a plurality of check valves are connected between the container and the first expansible chamber means and between the first expansible chamber means and the second expansible chamber means to control flow to and from the first and second expansible chamber means.

33. The combination as in claim 32, wherein a valving disc is molded integrally with said bulb, and said check valves are formed in the valving disc.

34. The combination as in claim 32, wherein a flat valving disc is carried by the manifold member, and the check valves are formed in the valving disc.

* * * * *